US007251965B2

(12) United States Patent
Yu

(10) Patent No.: US 7,251,965 B2
(45) Date of Patent: Aug. 7, 2007

(54) HANGING LOCK STRUCTURE

(76) Inventor: Chun-Te Yu, No.41-21, Kuan-Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 0 days.

(21) Appl. No.: 10/833,076

(22) Filed: Apr. 28, 2004

(65) Prior Publication Data

US 2005/0155395 A1 Jul. 21, 2005

(30) Foreign Application Priority Data

Jan. 20, 2004 (TW) ..... 93201230 U

(51) Int. Cl.
*E05B 37/02* (2006.01)

(52) U.S. Cl. ..... 70/21; 70/25; 70/26; 70/30; 70/49; 70/53

(58) Field of Classification Search ..... 70/21, 70/284, 285, 30, 49, 53, 20, 22, 25, 26, 31, 70/35–37, 38 R, 39, 38 A, 38 B, 38 C, DIG. 63, 70/DIG. 71

See application file for complete search history.

(56) References Cited

U.S. PATENT DOCUMENTS

| | | | | | |
|---|---|---|---|---|---|
| 1,755,521 | A * | 4/1930 | Smith | 70/21 |
| 2,931,204 | A * | 4/1960 | Check | 70/21 |
| 3,528,267 | A * | 9/1970 | Orr | 70/21 |
| 3,823,584 | A * | 7/1974 | Gill | 70/21 |
| 3,837,189 | A * | 9/1974 | Atkinson | 70/21 |
| 3,879,721 | A * | 4/1975 | Yereance | 70/441 |
| 4,055,972 | A * | 11/1977 | Calegan | 70/21 |
| 4,730,467 | A * | 3/1988 | Lebrecht | 70/25 |
| 4,918,951 | A * | 4/1990 | Kavizky | 70/53 |
| 5,694,797 | A * | 12/1997 | Kuo | 70/53 |
| 5,868,012 | A * | 2/1999 | Chun-Te et al. | 70/30 |
| 6,227,016 | B1 * | 5/2001 | Yu | 70/30 |
| 6,408,660 | B1 * | 6/2002 | Lai | 70/30 |
| 6,539,761 | B2 * | 4/2003 | Yang | 70/284 |
| 6,843,080 | B1 * | 1/2005 | Yu | 70/21 |
| 6,904,776 | B1 * | 6/2005 | Lin | 70/25 |
| 2002/0088256 | A1 * | 7/2002 | Taylor et al. | 70/25 |
| 2004/0226323 | A1 * | 11/2004 | Ling et al. | 70/25 |
| 2004/0226324 | A1 * | 11/2004 | Loughlin et al. | 70/25 |
| 2005/0092036 | A1 * | 5/2005 | Lai | 70/25 |

* cited by examiner

*Primary Examiner*—Lloyd A. Gall
(74) *Attorney, Agent, or Firm*—Bacon & Thomas, PLLC

(57) ABSTRACT

A hanging lock structure including a lock body and a lock hook. The lock body is formed with two lock holes. A numeral unlocking unit is disposed in the lock body corresponding to one of the lock holes. Each lock hole is composed of a larger insertion hole and a narrower slot communicating with the insertion hole. Two stop blocks are disposed in the lock body respectively corresponding to the lock holes. The lock hook has two free ends which are movable relative to each other. Each free end has an insertion head. The insertion heads of the free ends of the lock hook can be respectively inserted in the lock holes and controlled by the two unlocking units. When the stop blocks are such positioned as to block the insertion holes, the insertion heads are restricted within the slots to achieve a locking effect. Any of the numeral unlocking unit and the key-unlocking unit can drive any of the stop blocks to unblock any insertion hole so as to release any free end of the lock hook. Therefore, the hanging lock is double-unlockable.

9 Claims, 7 Drawing Sheets

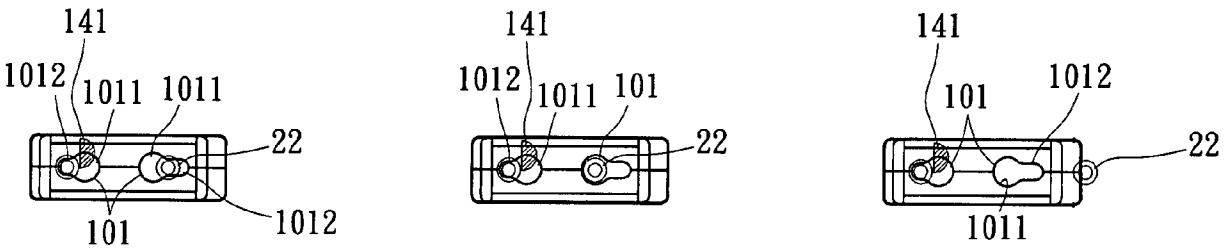
Fig. 3AA
Fig. 3BB
Fig. 3CC
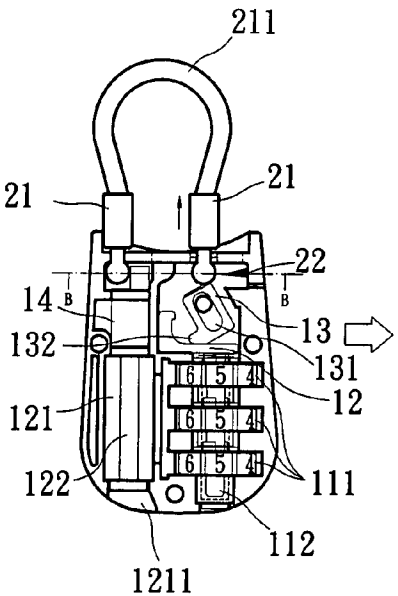
Fig. 3A
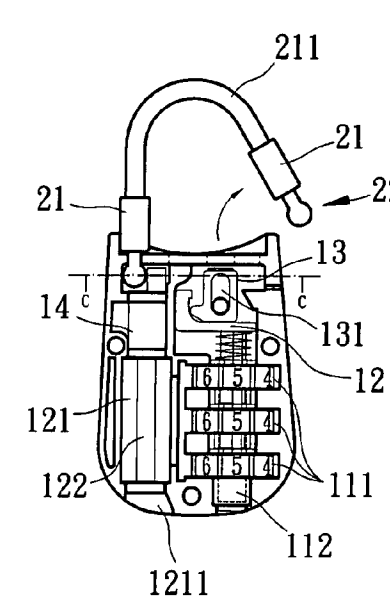
Fig. 3B
Fig. 3C

HANGING LOCK STRUCTURE

BACKGROUND OF THE INVENTION

The present invention is related to an improved hanging lock structure, and more particularly to a hanging lock structure with double locking effect.

The conventional hanging locks include numeral system and key-driven system. The numeral system includes numeral wheel type and press key type. These locking apparatuses are widely applied to various fields. For example, Taiwanese Patent No. 369068, entitled "hanging lock structure" and Taiwanese Patent No. 498918, entitled "hanging lock structure (5)" disclose locks pertaining to key-driven system. Taiwanese Patent No. 32470, entitled "numeral lock of baggage case or suitcase" and Taiwanese Patent No. 46563, entitled "adjustable numeral lock of suitcase" disclose locks pertaining to numeral system.

In another condition, it is known that when checked by foreign customs workers, in case it is found the customs workers that the contents of the baggage case or suitcase are suspicious and need to be checked, the customs workers are authorized by U.S. government to forcedly break off the lock of the baggage case or suitcase and open the same for checking the contents. The damaged lock will be a loss of a user and will lead to trouble and inconvenience to the user.

In order to improve the above situation, U.S. government and customs regulate that the lock manufacturers must provide a standard key for the customs for opening all the locks manufactured by the manufacturers. According to this regulation, there are several lock manufacturers all over the world who are allowed to manufacture such locks.

It is therefore tried by the applicant to provide a locking apparatus which meets the regulation of U.S. government and customs. In case a user forgets to bring the unlocking key or forgets the unlocking number, the locking apparatus provides another unlocking measure for the user.

SUMMARY OF THE INVENTION

It is therefore a primary object of the present invention to provide an improved hanging lock structure, and more particularly to a lock device with double locking and unlocking effect. The lock device meets the regulation of U.S. government and customs. In case a user forgets to bring the unlocking key or forgets the unlocking number, the locking apparatus provides another unlocking measure for the user.

According to the above object, the hanging lock structure includes a lock body and a lock hook. The lock body is formed with two lock holes. A numeral unlocking unit is disposed in the lock body corresponding to one of the lock holes. Each lock hole is composed of a larger insertion hole and a narrower slot communicating with the insertion hole. Two stop blocks are disposed in the lock body respectively corresponding to the lock holes. The lock hook has two free ends which are movable relative to each other. Each free end has an insertion head. The insertion heads of the free ends of the lock hook can be respectively inserted in the lock holes and controlled by the two unlocking units. When the stop blocks are such positioned as to block the insertion holes, the insertion heads are restricted within the slots to achieve a locking effect. Reversely, when any of the numeral unlocking unit and the key-unlocking unit drives any of the stop blocks to such a position as to unblock any insertion hole, the insertion head of any free end of the lock hook is permitted to move to the insertion hole and extracted out of the insertion hole. Therefore, the hanging lock is double-unlockable.

The present invention can be best understood through the following description and accompanying drawings wherein:

BRIEF DESCRIPTION OF THE DRAWINGS

FIG. 3A shows the unlocking operation of the numeral unlocking unit of the present invention in an initial stage;

FIG. 3AA is a sectional view taken along line A—A of FIG. 3A;

FIG. 3B shows that the free end of the lock hook is moved to the insertion hole of the lock hole;

FIG. 3BB is a sectional view taken along line B—B of FIG. 3B;

FIG. 3C shows that the free end of the lock hook is extracted out of the corresponding lock hole;

FIG. 3CC is a sectional view taken along line C—C of FIG. 3C;

FIG. 4AA is a sectional view taken along line A—A of FIG. 4A;

FIG. 4BB is a sectional view taken along line B—B of FIG. 4B;

FIG. 4CC is a sectional view taken along line C—C of FIG. 4C;

FIG. 5AA is a sectional view taken along line A—A of FIG. 5A;

FIG. 5BB is a sectional view taken along line B—B of FIG. 5B;

FIG. 5CC is a sectional view taken along line C—C of FIG. 5C;

FIG. 6AA is a sectional view taken along line A—A of FIG. 6A;

DETAILED DESCRIPTION OF THE PREFERRED EMBODIMENTS

Figure 1:
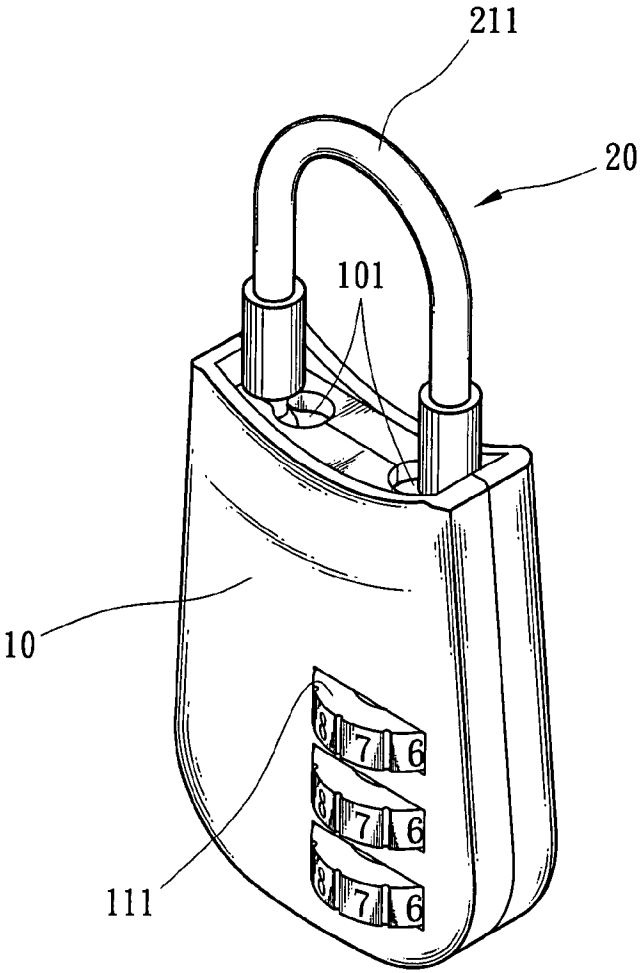
FIG. 1 is a perspective assembled view of the present invention.
Figure 2:
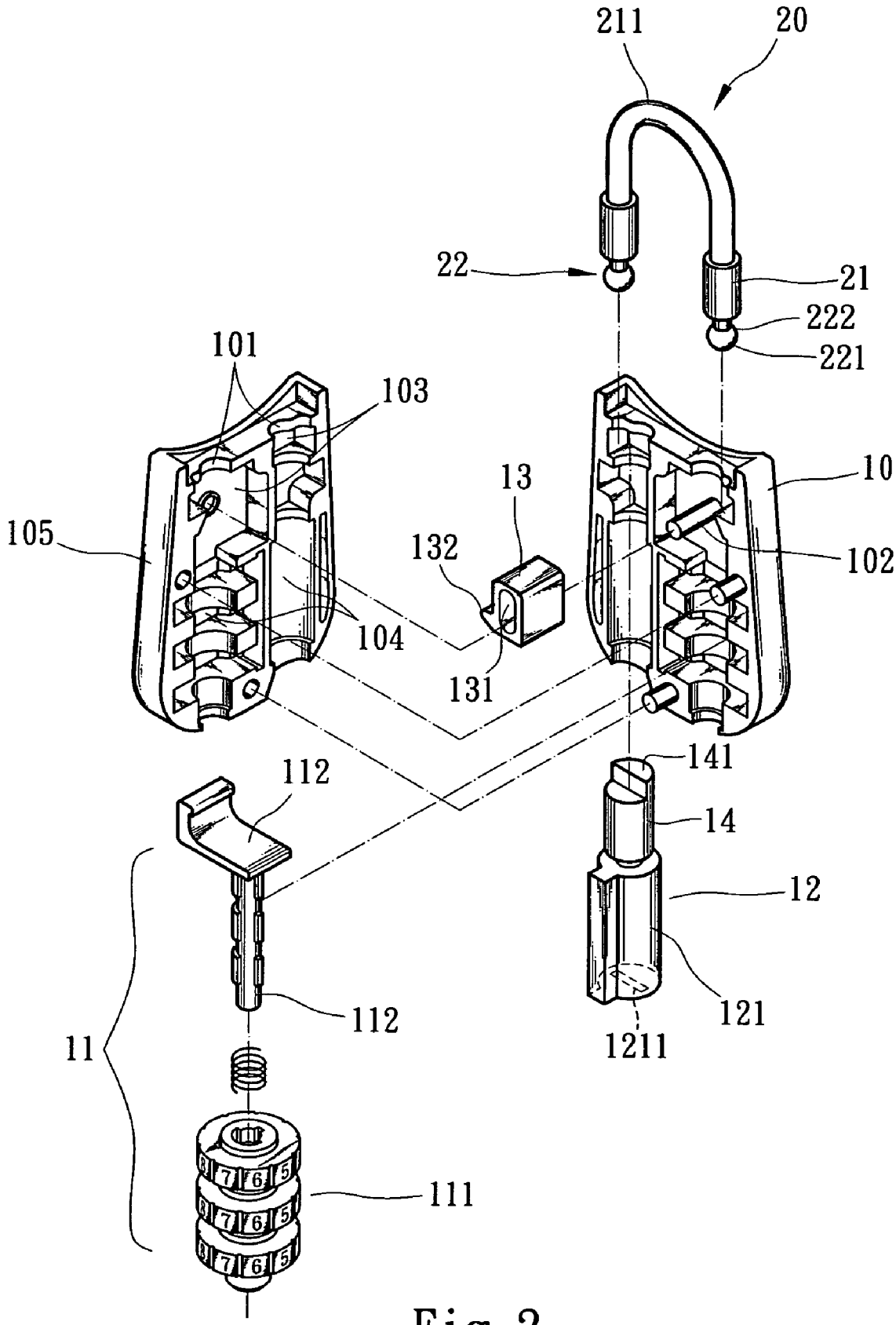
FIG. 2 is a perspective exploded view of the present invention.
Figure 7:
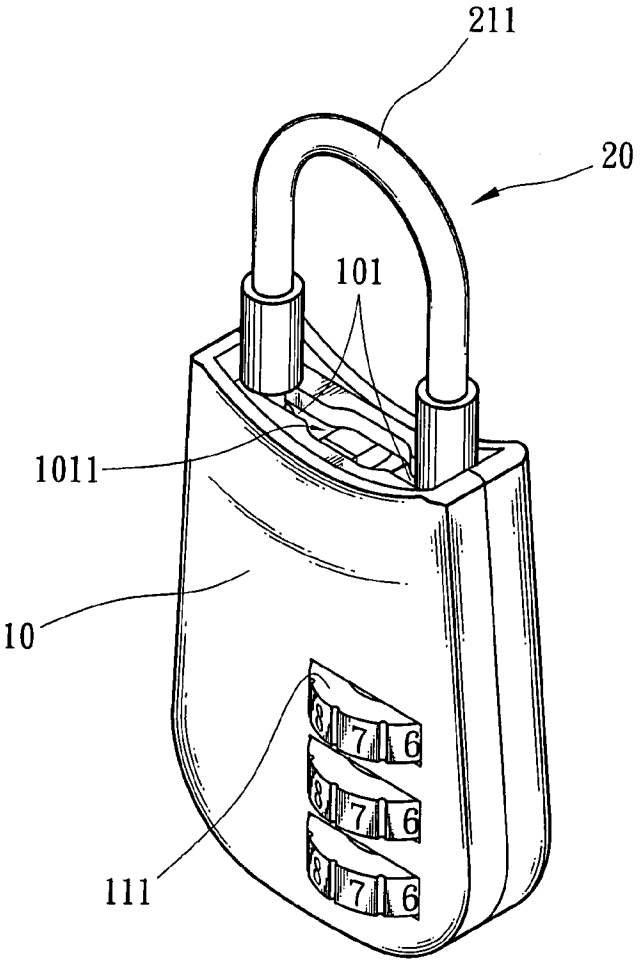
FIG. 7 is a perspective view showing another embodiment of the present invention, in which the insertion holes of the two lock holes are unified into one single insertion hole.

Please refer to FIGS. 1 and 2. The hanging lock of the present invention includes a lock body 10 and a lock hook 20. A numeral unlocking unit 11 is disposed in the lock body 10 corresponding to one end 21 of the lock hook 20. A key-unlocking unit 12 is disposed in the lock body 10 corresponding to the other end 21 of the lock hook 20. The lock body 10 is formed with two lock holes 101 respectively corresponding to the two unlocking units 11, 12. Each lock hole 101 is composed of a larger insertion hole 1011 and a narrower slot 1012 communicating with the insertion hole 1011 (as shown in FIG. 3). Alternatively, the insertion holes 1011 can communicate with each other to form one single hole (as shown in FIG. 7). Two stop blocks 13, 14 are disposed in the lock body 10 respectively corresponding to the lock holes 101. The two free ends 21 of the lock hook 20 can be moved relative to each other. Each free end 21 has an insertion head 22 movably inserted in the lock hole 101. The two unlocking units 11, 12 can control the stop blocks 13, 14, whereby when the insertion heads 22 are located in the slots 1012, the stop blocks 13, 14 can block the insertion holes 1011 to prevent the insertion heads 22 from being detached through the insertion holes 1011 of the lock holes 101.

The lock body 10 includes a left lock casing 105 and a right lock casing 105 mated with each other. The lock casings 105 define an upper receiving space 103 and a lower receiving space 104. The lower receiving space 104 is divided into two compartments for respectively accommodating the numeral unlocking unit 11 and the key-unlocking unit 12. The upper receiving space 103 is also divided into two compartments. The lock holes 101 are formed respectively corresponding to upper sides of the two compartments of the upper receiving space 103. The unlocking units 11, 12 are disposed respectively corresponding to lower sides of the compartments of the upper receiving space 103. A swinging stop block 13 is positioned in the receiving space 103 corresponding to upper side of the numeral unlocking unit 11. A rotary stop block 14 is positioned in the receiving space 103 corresponding to upper side of the key-unlocking unit 12. The swinging stop block 13 is formed with a longitudinal elongated hole 131 in which a projecting post 102 of the lock body 10 is fitted. Accordingly, the swinging stop block 13 can be swung left and right and displaced up and down within the upper receiving space 103. A pushing edge 132 extends from lower end of the swinging stop block 13. When swinging, the push edge 132 serves to press a lock core driving rod 112 of the numeral unlocking unit 11. The rotary stop block 14 is mounted in the other compartment of the upper receiving space 103. The upper end of the rotary stop block 14 is formed with an eccentric stop section 141. The lower end of the rotary stop block 14 is drivingly connected with the upper end of the key-unlocking unit 12. When rotated, the eccentric stop section 141 can block or unblock the insertion hole 1011 of the lock hole 101.

The free ends 21 of the lock hook 20 are movable relative to each other. The two ends 21 can be connected via a steel cord 211. Alternatively, the two ends 21 can be connected via links 20A as shown in FIG. 5. Each free end 21 is formed with an insertion head 22. The insertion head 22 has a bulge section 221 and a neck section 222 above the bulge section 221. The bulge section 221 can get into and out of the lock body 10 through the insertion hole 1011. The neck section 222 can be laterally moved within the slot 1012 to prevent the bulge section 221 from getting out of the lock body 10.

The numeral unlocking unit 11 includes a numeral wheel set 111 and a lock core driving rod 112 controlled and driven by the numeral wheel set 111. The driving rod 112 is fitted in the numeral wheel set 111. When all the numeral wheels are turned to the correct unlocking position, the driving rod 112 can be axially displaced within the center of the numeral wheel set 111. Accordingly, the swinging stop block 13 can be biased or displaced up and down to axially push the driving rod 112. Reversely, when the numeral wheel set 111 is not completely turned to the correct unlocking position, the driving rod 112 cannot be axially displaced. Under such circumstance, the swinging stop block 13 is stopped and prevented from being biased or displaced up and down.

The key-unlocking unit 12 includes a lock sleeve 121 and a lock core 122 fitted in the lock sleeve 121 (as shown in FIG. 3). The upper end of the lock core 122 is connected with lower side of the rotary stop block 14. The lower end of the lock core 122 is formed with a keyhole 1211 in which a key 30 can be inserted to control locking/unlocking of the key-unlocking unit 12.

Referring to FIGS. 3A to 3CC which show the operation of the numeral unlocking unit 111, when the numeral wheel set 111 is turned to an unlocked state, the driving rod 112 can be axially displaced within the center of the numeral wheel set 111. Accordingly, the swinging stop block 13 can be biased or displaced up and down. When a user laterally moves the insertion head 22 toward the insertion hole 1011, the insertion head 22 can push the swinging stop block 13 to swing and displace downward. At this time, the push edge 132 of the swinging stop block 13 presses the driving rod 112 to axially move. Accordingly, the swinging stop block 13 can be pushed to unblock the insertion hole 1011 of the lock hole 101. Therefore, the insertion head 22 can be extracted out of the lock hole 101 to form an unlocked state. Reversely, when the numeral wheel set 111 is turned to the locked state, the driving rod 112 cannot be axially moved so that the swinging stop block 13 is stopped by the top end of the driving rod 112 and prevented from swinging or displacing up and down. Therefore, the swinging stop block 13 keeps blocking the insertion hole 1011. Under such circumstance, the insertion head 22 cannot push the swinging stop block 13 to unblock the insertion hole 101. Accordingly, the insertion head 22 is restricted within the slot 1012 in a locked state.

Figure 4A:
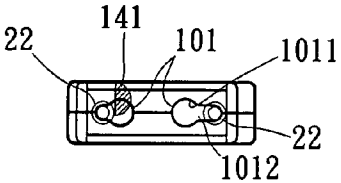
FIG. 4A shows the key-unlocking unit of the present invention in a locked state.
Figure 4B:
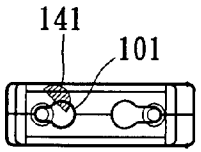
FIG. 4B shows the key-unlocking unit of the present invention in an unlocked state.
Figure 4C:
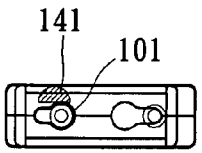
FIG. 4C shows that the free end of the lock hook is extracted out of the lock hole.
Figure 4A:
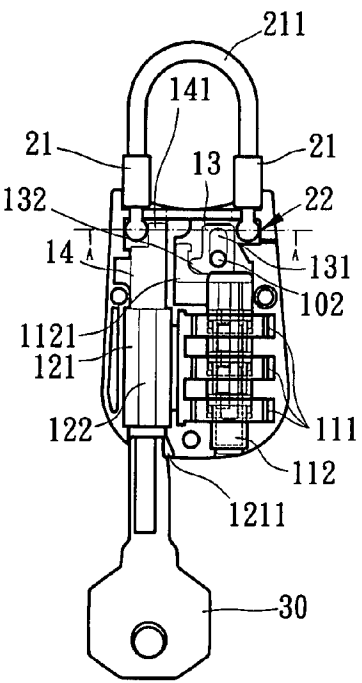
Figure 4B:
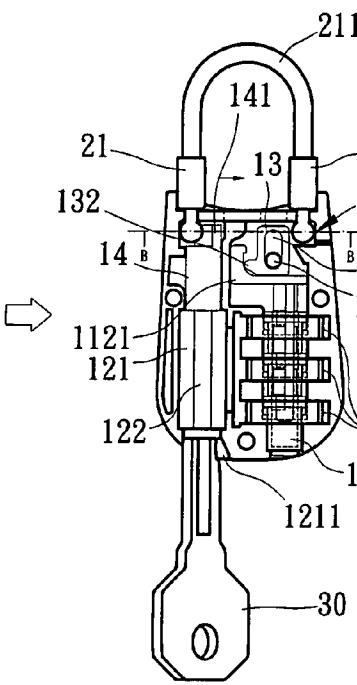
Figure 4C:
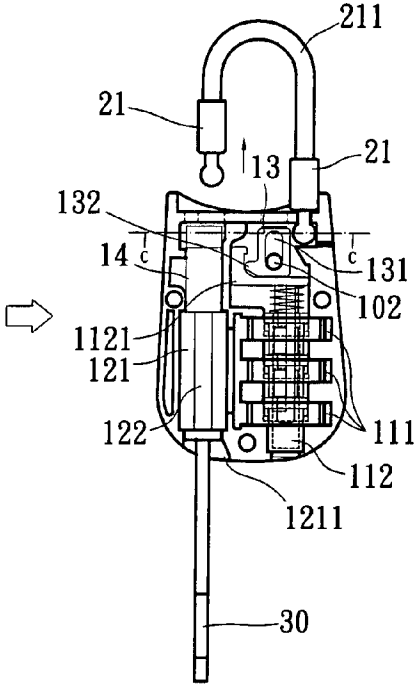

Please refer to FIGS. 4A to 4CC which show the operation of the key-unlocking unit 12. When the key 30 is inserted into the keyhole 1211 and turned to an unlocked state, the lock core 122 drives the rotary stop block 14 connected with the upper end of the lock core 122. Accordingly, the eccentric stop section 141 no more blocks the insertion hole 1011 of the lock hole 101, permitting the insertion head 22 to be moved from inner side of the slot 1012 to the larger insertion hole 1011. Then the insertion head 22 can be extracted out of the lock hole 101 into an unlocked state. Reversely, when the key 30 is turned to a locked state, the insertion head 22 of the lock hook 20 inserted in the lock hole 101 will be stopped by the eccentric stop section 141 of the rotary stop section 14 from moving from the slot 1012 to the insertion hole 1011. Accordingly, the insertion head 22 cannot be extracted out of the lock hole 101 in a locked state.

Figure 5A:
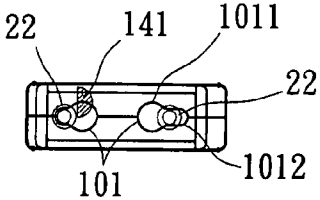
FIG. 5A shows the unlocking operation of another embodiment of the numeral unlocking unit of the present invention in an initial stage, in which the numeral unlocking unit has a link-type lock hook.
Figure 5B:
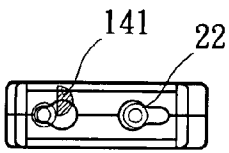
FIG. 5B shows that the free end of the link-type lock hook is moved to the insertion hole of the lock hole.
Figure 5C:
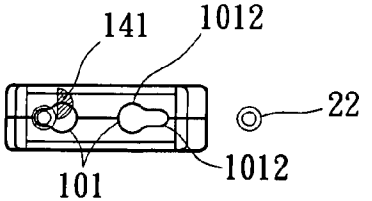
FIG. 5C shows that the free end of the link-type lock hook is extracted out of the corresponding lock hole.
Figure 5A:
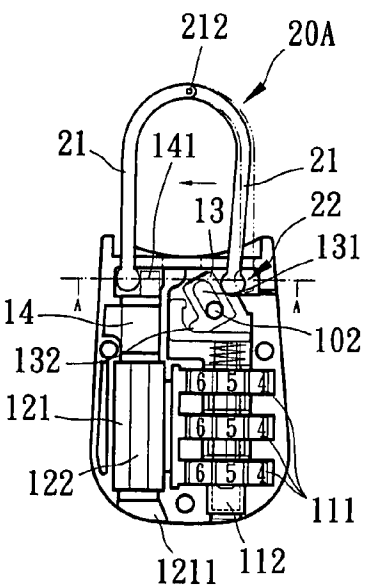
Figure 5B:
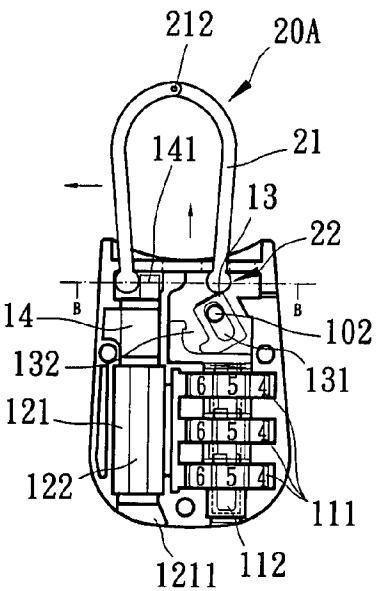
Figure 5C:
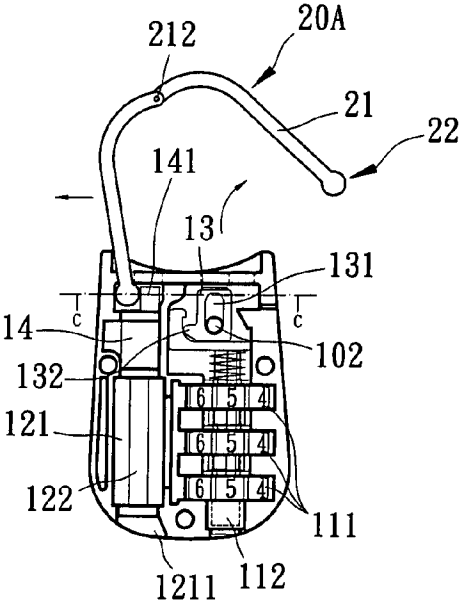

FIGS. 5A to 5CC show another embodiment of the present invention, in which the lock hook 20A is composed of two link-type rigid bodies each having a free end 21. The upper ends of the two link-type rigid bodies are pivotally connected via a pivot shaft 212, whereby the free ends 21 can be moved relative to each other. This can achieve the same operation mode.

Figure 6C:
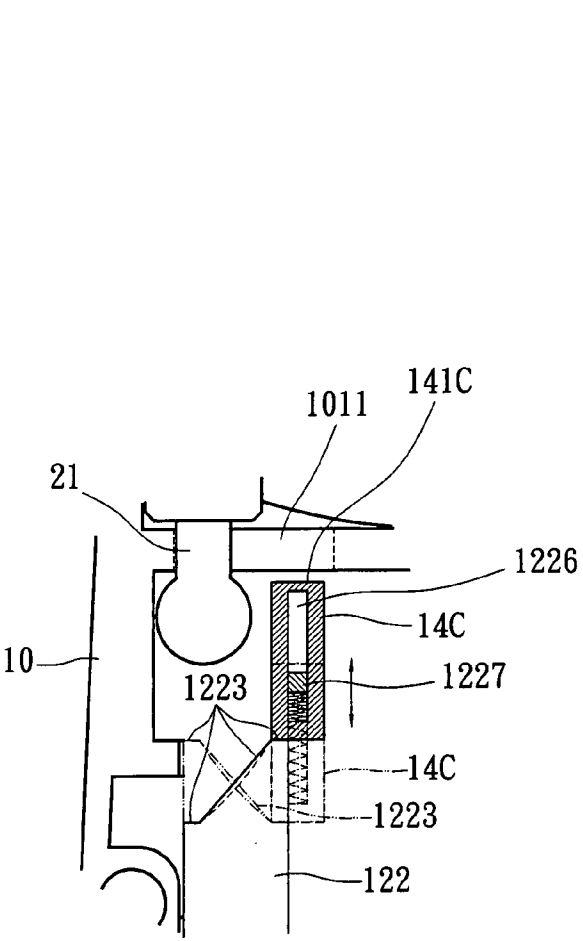
FIG. 6C shows still another embodiment of the lock core and stop block of the key-unlocking unit of the present invention.
Figure 6B:
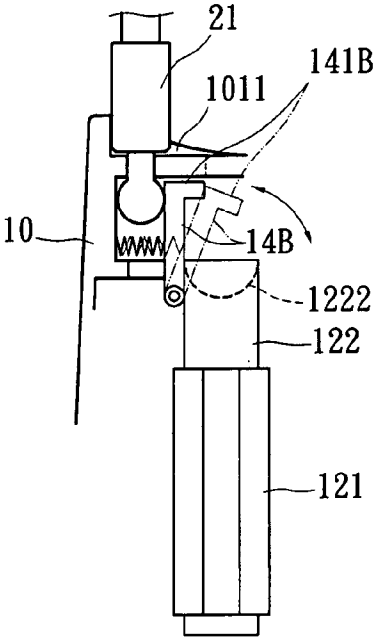
FIG. 6B shows still another embodiment of the lock core and stop block of the key-unlocking unit of the present invention.
Figure 6A:
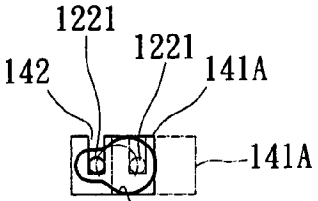
FIG. 6A shows another embodiment of the lock core and stop block of the key-unlocking unit of the present invention.
Figure 6A:
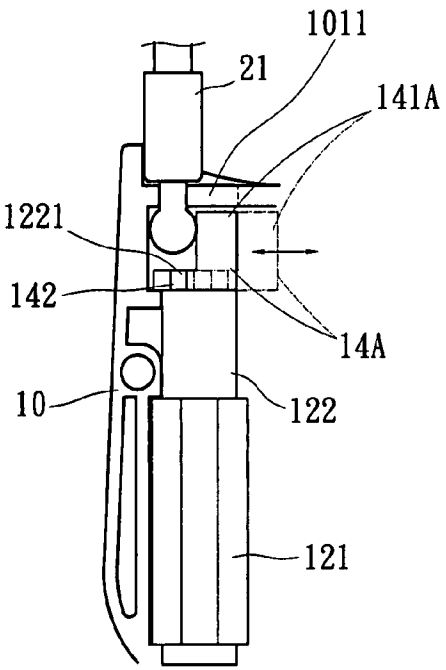

FIGS. 6A to 6AA show another embodiment of the lock core 122 and rotary stop block 14 of the key-unlocking unit 12 of the present invention. The upper end of the lock core 122 is formed with an eccentric shaft 1221. The rotary stop block 14 is replaced by a transversely slidable stop block 14A. The transversely slidable stop block 14A has a guide channel 142 and an upward projecting stop section 141A. When the key 30 is inserted into the keyhole 1211 and turned to an unlocked state, the eccentric shaft 1221 of upper end of the lock core 122 is swung within the guide channel 142 to drive the transversely slidable stop block 14A. Accordingly, the projecting stop section 141A no more blocks the insertion hole 1011 of the lock hole 101, permitting the insertion head 22 to move from inner side of the slot 1012 to the larger insertion hole 1011. Then the insertion head 22 can be extracted out of the lock hole 101 into an unlocked state. Reversely, when the key 30 turns the key-unlocking unit 12 into a locked state, the insertion head 22 of the lock hook 20 inserted in the lock hole 101 is stopped by the stop section 141A of the transversely slidable stop block 14A. Therefore, the insertion head 22 cannot be moved from the slot 1012 to the insertion hole 1011. Accordingly, the insertion head 22 cannot be extracted out of the lock hole 101 in a locked state.

FIG. 6B shows still another embodiment of the lock core 122 and rotary stop block 14 of the key-unlocking unit 12 of the present invention. A guide slope 1222 is formed on upper end of the lock core 122. The rotary stop block 14 is replaced by a resilient swinging column 14B. The swinging column 14B is controlled by the guide slope 1222 to swing between a vertical position and an oblique position. The swinging column 14B has a stop section 141B at upper end. When the key 30 is inserted into the keyhole 1211 and turned to an unlocked state, the guide slope 1222 of the upper end of the lock core 122 contacts with the swinging column 14B to bias the swinging column 14B. Therefore, the stop section 141B no more blocks the insertion hole 1011 of the lock hole 101, whereby the insertion head 22 can be moved from the inner side of the slot 1012 to the insertion hole 1011 and then extracted out of the lock hole 101 into an unlocked state. Reversely, when the key 30 turns the key-unlocking unit 12 into a locked state, the insertion head 22 of the lock hook 20 inserted in the lock hole 101 is stopped by the stop section 141B of the upper end of the swinging column 14B and cannot be moved from the slot 1012 to the insertion hole 1011. Accordingly, the insertion head 22 cannot be extracted out of the lock hole 101 in a locked state.

FIGS. 6C shows still another embodiment of the lock core 122 and rotary stop block 14 of the key-unlocking unit 12 of the present invention. An ascending/descending slope 1223 is formed on upper end of the lock core 122. The rotary stop block 14 is replaced by a resilient longitudinal slide block 14C. The longitudinal slide block 14C has a guide way 1226 in which a projecting post 1227 of the lock casing 105 is fitted. The lower end of the slide block 14C is controlled by the ascending/descending slope 1223 to move vertically. The slide block 14C has a stop section 141C at upper end. When the key 30 is inserted into the keyhole 1211 and turned to an unlocked state, the lower slope 1223 of the lock core 122 contacts with the bottom of the longitudinal slide block 14C to move the longitudinal slide block 14C downward. Therefore, the stop section 141C of the upper end of the longitudinal slide block 14C no more blocks the insertion hole 1011 of the lock hole 101, whereby the insertion head 22 can be moved from the inner side of the slot 1012 to the insertion hole 1011 and then extracted out of the lock hole 101 into an unlocked state. Reversely, when the key 30 turns the key-unlocking unit 12 into a locked state, the upper plane face 1224 of the lock core 122 contacts with the bottom of the longitudinal slide block 14C to move the longitudinal slide block 14C upward. Therefore, the insertion head 22 of the lock hook 20 inserted in the lock hole 101 is stopped by the stop section 141C of the upper end of the longitudinal slide block 14C and cannot be moved from the slot 1012 to the insertion hole 1011. Accordingly, the insertion head 22 cannot be extracted out of the lock hole 101 in a locked state.

The above embodiments are only used to illustrate the present invention, not intended to limit the scope thereof. Many modifications of the above embodiments can be made without departing from the spirit of the present invention.

What is claimed is:

1. A hanging lock structure comprising:

a) a lock body having:

i) an interior divided into two compartments;

ii) a numeral unlocking unit movable between locked and unlocked positions and located in a first compartment of the two compartments;

iii) a key unlocking unit movable between locked and unlocked positions and located in a second compartment of the two compartments; and iv) two lock holes, a first lock hole communicating with the first compartment, a second lock hole communicating with the second compartment; and b) a lock hook having an insertion head located on each of first and second ends thereof, the insertion head of the first end is inserted into the first lock hole and selectively locked therein by the numeral unlocking unit, the insertion head of the second end is inserted into the second lock hole and selectively locked therein by the key unlocking unit, the key unlocking unit operates independently from the numeral unlocking unit, wherein, independent of the key unlocking unit, when the numeral unlocking unit is in the locked position, the insertion head of the first end is locked in the lock body, and, when the numeral unlocking unit is in the unlocked position, the insertion head of the first end is removable from the lock body, wherein, independent of the numeral unlocking unit, when the key unlocking unit is in the locked position, the insertion head of the second end is locked in the lock body, and, when the key unlocking unit is in the unlocked position, the insertion head of the second end is removable from the lock body.

2. The hanging lock structure according to claim 1, wherein each of the first and the second lock holes includes an insertion hole and a slot communicating with the insertion hole, the insertion hole having a diameter larger than a diameter of the slot, the lock body includes a first stop block and a second stop block, the first stop block is controlled by the numeral unlocking unit and locking the insertion head of the first end of the lock hook in the slot of the first lock hole when the numeral unlocking unit is in the locked position, and second stop block is controlled by the key unlocking unit and locking the insertion head of the second end of the lock hook in the slot of the second lock hole when the key unlocking unit is in the locked position.

3. The hanging lock structure according to claim 2, wherein the first stop block is a swinging stop block having a longitudinal elongated hole, the lock body having a projecting post inserted into the longitudinal elongated hole, the swinging stop block is movable in directions including clockwise, counter clockwise, upwardly, and downwardly relative to the projecting post.

4. The hanging lock structure according to claim 3, wherein the numeral unlocking unit has a numeral wheel set and a driving rod connected to and controlled by a lock core of the numeral wheel set, a first end of the driving rod engaging a pushing edge of the swinging stop block.

5. The hanging lock structure according to claim 2, wherein the second stop block is a rotary stop block located on a first end of the key unlocking unit.

6. The hanging lock structure according to claim 5, further comprising a key, the key unlocking unit has a lock sleeve and a lock core located in the lock sleeve, a first end of the lock core has a keyhole, a second end of the lock core is connected to a first end of the rotary stop block, the key is inserted into the keyhole and selectively moving the key unlocking unit between locked and unlocked positions.

7. The hanging lock structure according to claim 5, wherein the rotary stop block has an eccentric stop section located on a second end thereof.

8. The hanging lock structure according to claim 1, wherein the lock hook is made of a resilient steel cord.

9. The hanging lock structure according to claim 1, wherein each insertion head of the first and second ends of the lock hook has a bulge section and a neck section.

* * * * *